United States Patent [19]

Klotz et al.

[11] Patent Number: 5,051,155

[45] Date of Patent: Sep. 24, 1991

[54] PROCESSES FOR THE PREPARATION OF ALKALI METAL DICHROMATES AND CHROMIC ACID

[75] Inventors: Helmut Klotz, Bergisch; Hans D. Pinter, Pulheim; Rainer Weber, Leverkusen; Hans-Dieter Block, Leverkusen; Norbert Lönhoff, Leverkusen, all of Fed. Rep. of Germany

[73] Assignee: Bayer Aktiengesellschaft, Leverkusen, Fed. Rep. of Germany

[21] Appl. No.: 632,417

[22] Filed: Dec. 21, 1990

Related U.S. Application Data

[63] Continuation of Ser. No. 393,447, Aug. 14, 1989, abandoned.

[30] Foreign Application Priority Data

Aug. 27, 1988 [DE] Fed. Rep. of Germany ..... 3829122

[51] Int. Cl.[5] ..... C25B 1/00; C25B 1/22

[52] U.S. Cl. ..... 204/59 R; 204/89; 204/97

[58] Field of Search ..... 204/89, 97, 59 R

[56] References Cited

U.S. PATENT DOCUMENTS 2,333,578 11/1943 Knox Jr. et al. ..... 204/89

FOREIGN PATENT DOCUMENTS 739447 7/1966 Canada .

OTHER PUBLICATIONS

Chemical Abstracts, vol. 87, No. 20, Nov. 14, 1977, p. 463, Paragraph No. 159202k, Columbus, Ohio, US; & JP-A-77 81 097 (K. Saito) 07-07-1977.

Ullmanns Encyclopedia of Industrial Chemistry, 5th Edition, Volum A 7, 1986 pp. 67-97.

*Primary Examiner*—John F. Niebling

*Assistant Examiner*—Kathryn Gorgos

*Attorney, Agent, or Firm*—Sprung, Horn, Kramer & Woods

[57] ABSTRACT

A process for the preparation of alkali metal dichromates and chromic acid by the electrolysis of monochromate and/or dichromate solutions in an electrolytic cell in which the anode and cathode chambers are separated by cation exchange member, the improvement wherein the formation of deposits on the membrane is prevented comprising continuously introducing a solution containing chromate at a pH of about 3 to 10 into the cathode chamber during the electrolysis.

2 Claims, No Drawings

PROCESSES FOR THE PREPARATION OF ALKALI METAL DICHROMATES AND CHROMIC ACID

This application is a continuation of application Ser. No. 393,447, filed Aug. 14, 1989, now abandoned.

BACKGROUND OF THE INVENTION

1. Field of the Invention

This invention relates to processes for the preparation of alkali metal dichromates and chromic acid by the electrolysis of monochromate and/or dichromate solutions in electrolytic cells in which the anode chamber and cathode chamber are separated by cation exchanger membranes.

2. Description of the Related Art

According to U.S. Pat. No. 3,305,463 and CA-A-739,447, the electrolytic preparation of alkali metal dichromate and chromic acid ($CrO_3$) is carried out in electrolytic cells in which the electrode chambers are separated by a cation exchanger membrane.

For the production of alkali metal dichromates, alkali metal monochromate solutions or suspensions are introduced in the anode chamber and converted into alkali metal dichromate solutions by the selective transfer of alkali metal ions into the cathode chamber through the membrane. For the preparation of chromic acid, alkali metal dichromate or alkali metal monochromate solutions or a mixture of alkali metal dichromate and alkali metal monochromate solutions are introduced into the anode chamber and converted into solutions containing chromic acid. Sodium monochromate and/or sodium dichromate solutions are generally used for these processes. In both processes, an alkaline solution containing alkali metal ions is obtained in the cathode chamber. This solution may consist, for example, of an aqueous sodium hydroxide solution or, as described in CA-A-739 447, of an aqueous solution containing sodium carbonate.

For the production of alkali metal dichromate or chromic acid crystals, the solution formed in the anode chambers of the cells is concentrated by evaporation to enable the crystallization of sodium dichromate, for example, to take place at 80° C. and the crystallization of chromic acid at 60° to 100° C. The crystallized products are separated off, optionally washed and dried.

When this process is carried out, compounds of polyvalent ions, in particular of alkaline earth ions, are deposited in the membrane and rapidly impair the functional efficiency of the membrane until it completely fails. The formation of these deposits is due to the presence of small amounts of polyvalent cations, in particular calcium and strontium ions, in the sodium dichromate and/or sodium monochromate solutions used as electrolytes such as those obtainable by the industrial processes described in Ullmanns Encyclopedia of Industrial Chemistry, 5th Edition, Volume A 7, 1986, pages 67–97.

It was an object of this invention to provide processes for the preparation of alkali metal dichromates and chromic acid by electrolysis which would be free from the disadvantages described above.

SUMMARY OF THE INVENTION

It has now surprisingly been found that the above-mentioned disadvantages do not occur if a solution containing a chromate is continuously introduced at a pH of 3 to 10 into the cathode chamber.

This invention relates to processes for the preparation of alkali metal dichromates and chromic acid by the electrolysis of monochromate and/or dichromate solutions in electrolytic cells in which the anode and cathode chambers are separated by cation exchange membranes, characterised in that a chromate-containing solution is continuously introduced at a pH of 3 to 10 into the cathode chamber.

DESCRIPTION OF PREFERRED EMBODIMENTS

The chromate-containing solution may be an alkali metal monochromate or alkali metal dichromate solution of the kind obtained in industrial processes but mixtures of the two chromate solutions may also be used. Chromate-containing solutions with pH values of from 3.5 to 6.0 are particularly preferred. It is also possible in principle to use chromate-containing solutions at pH values below 3 so that chromic acid and solutions containing polychromates may be used.

The process according to the invention avoids the formation of deposits in the membrane. The service life of the membrane is therefore considerably increased so that a continuous and prolonged electrolytic process is ensured. The current yield is also considerably improved.

The solution formed in the cathode chamber may be completely used for the preparation of alkali metal dichromate by the carbon dioxide, sulphuric acid or electrolytic process.

The process according to the invention is described more fully below with the aid of the examples which follow.

The electrolytic cells used in the examples consisted of anode chambers of pure titanium and cathode chambers of refined steel. The membranes were Nafion® 324 cation exchanger membranes of Du Pont. The cathodes consisted of refined steel and the anodes of expanded titanium metal with an electrocatalytically active layer of tantalum oxide and iridium oxide. Anodes of this type are described, for example, in U.S. Pat. No. 3,878,083.

The distance between the electrodes and the membrane was in all cases 1.5 mm. Sodium dichromate solutions containing 800 g/l of $Na_2Cr_2O_7 \cdot 2\ H_2O$ and the impurities stated in the individual examples were introduced into the anode chambers.

Water was introduced into the cathode chambers at such a rate, except where otherwise indicated in the examples, that the sodium hydroxide solution leaving the cells was at a concentration of 20%. The temperature for electrolysis was in all cases 80° C. and the current density of the projected surface area of anode and cathode facing the membrane was 3 kA/m$^2$; this surface area was 11.4 cm . 6.7 cm.

EXAMPLE 1

The sodium dichromate solutions used in this experiment contained the following impurities:

| | | |
|---|---|---|
| Calcium: | 290–293 | mg/l |
| Strontium: | less than 0.5 | mg/l |
| Magnesium: | less than 0.5 to 1.7 | mg/l |
| Sulphate, $SO_4^{2-}$: | 0.17 to 1.47 | g/l. |

These solutions were electrolytically converted into a solution containing chromic acid in the electrolytic cell described. The speed of introduction of the sodium dichromate solutions was chosen so that a molar ratio of sodium ions to chromium(VI) of about 0.8 became established in the anolyte leaving the cell. In the course of the experiment, the cell voltage rapidly rose from an initial 4.7V to 6.2V and then reached a value of 7.0V after 18 days. The average current yield during this time was about 68%. On the 25th day, the cell voltage fell to 3.8V and the current yield to about 46%, indicating that the functional efficiency of the membrane had considerably deteriorated. After termination of the experiment after 29 days, the membrane was completely permeated with white deposits consisting mainly of calcium hydroxide. In addition, the membrane was found to have several blisters about 3 to 5 mm in diameter, and some of these blisters had burst. At this stage, the membrane was destroyed.

EXAMPLE 2

A sodium dichromate solution containing the following impurities was used in this experiment:

| | | |
|---|---|---|
| Calcium: | 290 | mg/l |
| Strontium: | less than 0.5 | mg/l |
| Magnesium: | less than 0.5 | mg/l |
| Sulphate: | 154 | mg/l. |

In contrast to Example 1, the speed of introduction of this solution was adjusted so that a molar ratio of sodium ions to chromium(VI) of about 0.4 became established in the anolyte leaving the cell.

The cell voltage rose during the experiment from an initial 4.8V to 6.3V within 17 days. The average current yield during this time was about 33%. On the 18th day, the cell voltage fell to 3.8V and the current yield to about 19%. This indicated, as in Example 1, a loss in the functional efficiency of the membrane. After termination of the experiment, the membrane showed a smaller quantity of white deposits but blisters measuring about 3 to 5 mm had again formed, and some of these had burst. The membrane was thus destroyed.

EXAMPLE 3

A sodium dichromate solution containing the following impurities was used in this example according to the invention.

| | | |
|---|---|---|
| Calcium: | 290 | mg/l |
| Strongium: | less than 0.5 | mg/l |
| Magnesium: | less than 0.5 | mg/l |
| Sulphate: | 154 | mg/l. |

In contrast to Examples 1 and 2, the same sodium dichromate solution which was introduced into the anode chamber was also introduced into the cathode chamber instead of water. The speed of introduction was in this case adjusted so that a pH of from 6.5 to 6.7 became established in the catholyte leaving the cell. The sodium dichromate solution was introduced into the anode chamber at such a rate that a molar ratio of sodium ions to chromium(VI) of about 0.6 became established in the anolyte. During the experiment, the cell voltage rose only insignificantly within 27 days, namely from 4.8V to 5.0V. The average current yield during this period was about 64%. Inspection of the membrane carried out on the 27th day showed that neither white deposits nor blisters had formed in the membrane. The membrane was thus fully functional, as also indicated by the almost constant cell voltage. When the experiment was resumed on the 28th day, the cell voltage of 5.0V found on the 27th day was re-established. The introduction of sodium dichromate instead of water into the cathode chamber of the cell not only prevented the formation of deposits and blisters but also significantly improved the current yield, as may be seen from a comparison with the following example.

EXAMPLE 4

The sodium dichromate solutions used in this experiment had the following impurities:

| | | |
|---|---|---|
| Calcium: | 0.5 to 1.5 | mg/l |
| Strontium: | less than 0.5 | mg/l |
| Magnesium: | less than 0.5 | mg/l |
| Sulphate: | 178 to 189 | mg/l. |

Apart from the introduction of water instead of sodium dichromate solution into the cathode chamber, the experimental conditions were the same as in Example 3.

During the experiment, the cell voltage rose within 27 days from an initial 4.5V to 5.2V. The average current yield during this period was 61% and thus considerably lower than in Example 3.

What is claimed is:

1. A process for the preparation of alkali metal dichromates and chromic acid in an anode chamber of an electrolytic cell having anode and cathode chambers which are separated by a cation exchanger membrane, said process comprising:

(a) introducing alkali metal monochromate solutions, alkali metal dichromate solutions, or a mixture of alkali metal monochromate and alkali metal dichromate solutions into the anode chamber of the electrolytic cell;

(b) converting the alkali metal monochromate solutions, alkali metal dichromate solutions, or mixture of alkali metal monochromate and alkali metal dichromate solutions in the anode to chamber into alkali metal dichromate solutions or chromic acid in the anode chamber by a selective electrolytic migration of alkali metal ions through the cation exchanger membrane into the cathode chamber; and (c) continuously introducing a solution containing chromate at a pH of about 3 to 10 into the cathode chamber.

2. A process according to claim 1, wherein the pH of the chromate-containing solution is from about 3.5 to 6.0.

* * * * *